United States Patent [19]

Price et al.

[11] Patent Number: 4,718,739

[45] Date of Patent: Jan. 12, 1988

[54] DOCUMENT STORAGE SYSTEM

[75] Inventors: Macy J. Price, Golden; Laurence G. Ball, Westminster; Macy J. Price, Jr., Broomfield; Mack E. Johnson, Littleton, all of Colo.

[73] Assignee: Engineered Data Products, Inc., Broomfield, Colo.

[21] Appl. No.: 928,289

[22] Filed: Nov. 7, 1986

[51] Int. Cl.[4] ..... A47B 63/00

[52] U.S. Cl. ..... 312/184; 312/188; 402/38

[58] Field of Search ..... 312/184, 188, 183; 402/17, 38, 4

[56] References Cited

U.S. PATENT DOCUMENTS

| | | | |
|---|---|---|---|
| 727,881 | 5/1903 | Beckbissinger | 312/184 |
| 1,335,415 | 3/1920 | Adams | 312/184 |
| 3,865,445 | 2/1975 | Dean et al. | 312/184 |
| 3,980,360 | 9/1976 | Wright et al. | 312/184 |
| 4,056,296 | 11/1977 | Hedstrom et al. | 312/184 |
| 4,171,854 | 10/1979 | Hedstrom et al. | 312/184 |
| 4,302,123 | 11/1981 | Dengler et al. | 402/17 |
| 4,312,453 | 1/1982 | Barber | 312/184 |
| 4,325,595 | 4/1982 | Solomon | 312/183 |
| 4,515,420 | 5/1985 | Crosch | 312/183 |

FOREIGN PATENT DOCUMENTS

| | | | |
|---|---|---|---|
| 1080400 | 12/1954 | France | 312/184 |
| 181364 | 9/1959 | Netherlands | 312/184 |

*Primary Examiner*—Victor N. Sakran

*Attorney, Agent, or Firm*—Klaas & Law

[57] ABSTRACT

A system for supporting documents such as multi-leaf computer print-out documents is presented and uses a holder having a main support member having a pair of support posts for supporting documents and a closure member pivotally mounted on the main support member for movement between an open position wherein documents can be mounted on or removed from the support posts and an intermediate position having a portion superposed over the support posts. The closure member can be moved in a linear direction from the intermediate position to a fully closed position in which the main support member and the closure member are locked together. Guiding forces control the linear movement of the closure member and frictional forces function to hold the main support member and the closure member in the fully closed position.

33 Claims, 16 Drawing Figures

DOCUMENT STORAGE SYSTEM

FIELD OF THE INVENTION

This invention relates generally to the storage of documents, such as computer print-out documents, and more particularly to holders for such documents so that the documents may be secured together and filed in a storage space.

BACKGROUND OF THE INVENTION

Document holders for use in securing together loose leaf documents, such as computer print-out documents, have provided the basis for the invention in several U.S. patents, such as U.S. Pat. Nos. 3,865,445; 3,980,360; 4,056,296 and 4,171,854, all of which are incorporated herein by reference. The documents have a series of linearly aligned holes along one edge portion which are used to position the documents on support pins in the document holders which also have suitable means for releasably retaining the documents within the holder. Hooks are generally provided on each end of the document holder or in a central location so that the document holder can be supported on suitable racks in the storage space.

Some difficulties have been encountered in using document holders such as those disclosed in the above patents. When such a document holder is moved to an open position, the integral hinge portion thereof does not facilitate the placing of the document holder on a support surface so that the support posts will extend in a direction perpendicular to the support surface. This makes it difficult to position documents over the support posts. Also, when such a document holder, in a closed position and with documents therein, is placed on a support surface, the force being applied to unlock the document holder acts against the force being applied to open the document holder to make opening the document holder a difficult process.

BRIEF DESCRIPTION OF THE INVENTION

This invention provides a document storage system using a document holder having an integrally molded main support member and an integrally molded closure member that is pivotally mounted on the main support member. In use, the main support member when in a fully open position lies flat on a support surface so that support post means thereon extend in a direction perpendicular to the support surface so as to facilitate the insertion or removal of documents. The pivotal mounting permits pivotal movement of the closure member between a fully open position in which documents having holes along one edge portion thereof may be placed onto or removed from support post means on the main support member and an intermediate position wherein a portion of an inner surface of the closure member is superposed over the one edge portion of the documents and the support post means. The main support member and the closure member are provided with cooperating slide means so as to provide guided relative movement between the main support member and the closure member in a linear direction during movement between the intermediate position and a fully closed position. The main support member and the closure member are provided with cooperating locking means when in the fully closed position to lock the main support member and the closure member together. Friction producing means are used to hold the main support member and the closure member in the locked fully closed position and are designed and located so that the forces used to overcome the frictional force to move the closure member to an unlocked position act generally in the same direction as any force applied to move the closure member toward the fully open position.

It is an object of this invention to provide a document holder for loose leaf papers, such as computer print-out documents, so that the documents may be readily positioned therein and moved into or out of a storage space.

It is another object of this invention to provide a document holder for loose leaf papers, such as computer print-out documents, wherein the document holder may be positioned on a support surface so that pressure may be applied to a pair of projecting lugs to move a closure member relative to a main support member to unlock the document holder and the continued application of pressure pivots the closure member relative to the main support member to a fully open position for the easy insertion or removal of documents.

Additional objects, advantages, and novel features of the invention are set forth in the accompanying drawing, the detailed description and the claim.

BRIEF DESCRIPTION OF THE DRAWINGS

An illustrative and presently preferred embodiment of the invention is shown in the accompanying drawings in which:

FIG. 1 is a pictorial view of the preferred and illustrative embodiment of the apparatus of this invention when in a fully open position;

DETAILED DESCRIPTION OF THE INVENTION

Figures 2, 2A, 3, 7:
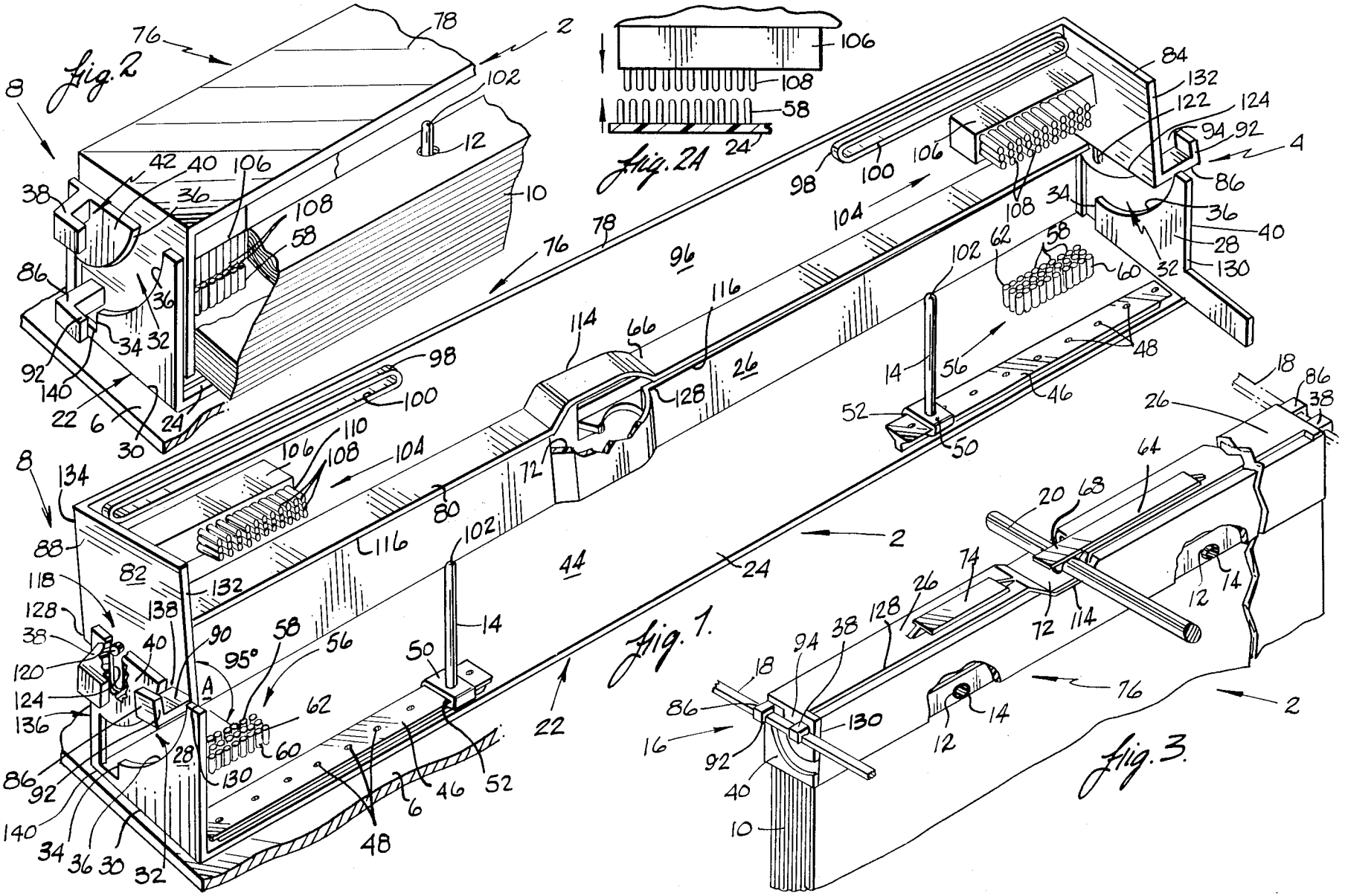
FIG. 2 is a pictorial view of a portion of the apparatus of FIG. 1 when in an intermediate position.
FIG. 2A is a side elevation view of a portion of the apparatus of FIGS. 1 and 2 immediately before the apparatus reaches the intermediate position.
FIG. 3 is a pictorial view of a portion of the apparatus of FIGS. 1, 2 and 2A when in a fully closed position and supported in a storage space.
FIG. 7 is a right end view of FIG. 4.

A preferred embodiment of the invention is illustrated in FIG. 1 wherein the apparatus 2 is in a fully open position 4 on a generally planar supporting surface 6, such as found on a desk, work table or the like. All of the parts of the apparatus 2 are preferably formed by an integral molding process using a high density plastic material, such as K-resin or polystyrene. In FIG. 2, a portion of the apparatus 2 is illustrated in an intermediate position 8 with a plurality of documents 10, such as computer print-out documents, having linear aligned holes 12 which permit the documents 10 to be placed over the support post means 14. In FIG. 3, the apparatus 2 is illustrated in a fully closed position 16 and supported on spaced side support rack bars 18 or a top rack rod 20, as described below, fixedly mounted in a suitable storage space, such as a conventional cabinet (not shown).

The apparatus as illustrated in FIG. 1 comprises a main support member 22, illustrated specifically in FIGS. 4–8, having an L-shaped cross-sectional configuration and made in one piece from a rigid molded plastic material and having a lower rigid horizontally extending elongated support plate portion 24, when positioned on a support surface 6, an integral upperwardly extending side flange portion 26 and upwardly extending end flange portions 28 integral with the support plate portion 24 and the side flange portion 26. The support plate portion 24 and the side flange portion 26 have generally rectangularly shaped cross-sectional configurations and generally parallel longitudinal axes. The support plate portion 24 has a generally planar outer surface 30 so that, when it is positioned on the generally planar supporting surface 6, the support post means 14 will extend in a direction generally perpendicular to the generally planar supporting surface 6. Each of the end flange portions 28 has an elongated slot 32 having a generally linear portion 34 and a generally arcuate portion 36 for a purpose described below. Each of the end flange portions 28 has an outwardly extending hook portion 38 which cooperates with a portion of the outer surface 40 of the end flange portion 28 to form a U-shaped recess 42 therebetween and is used to help support the apparatus when in a storage space as described below.

Figures 7, 8, 9, 10, 11, 12, 13, 14, 15:
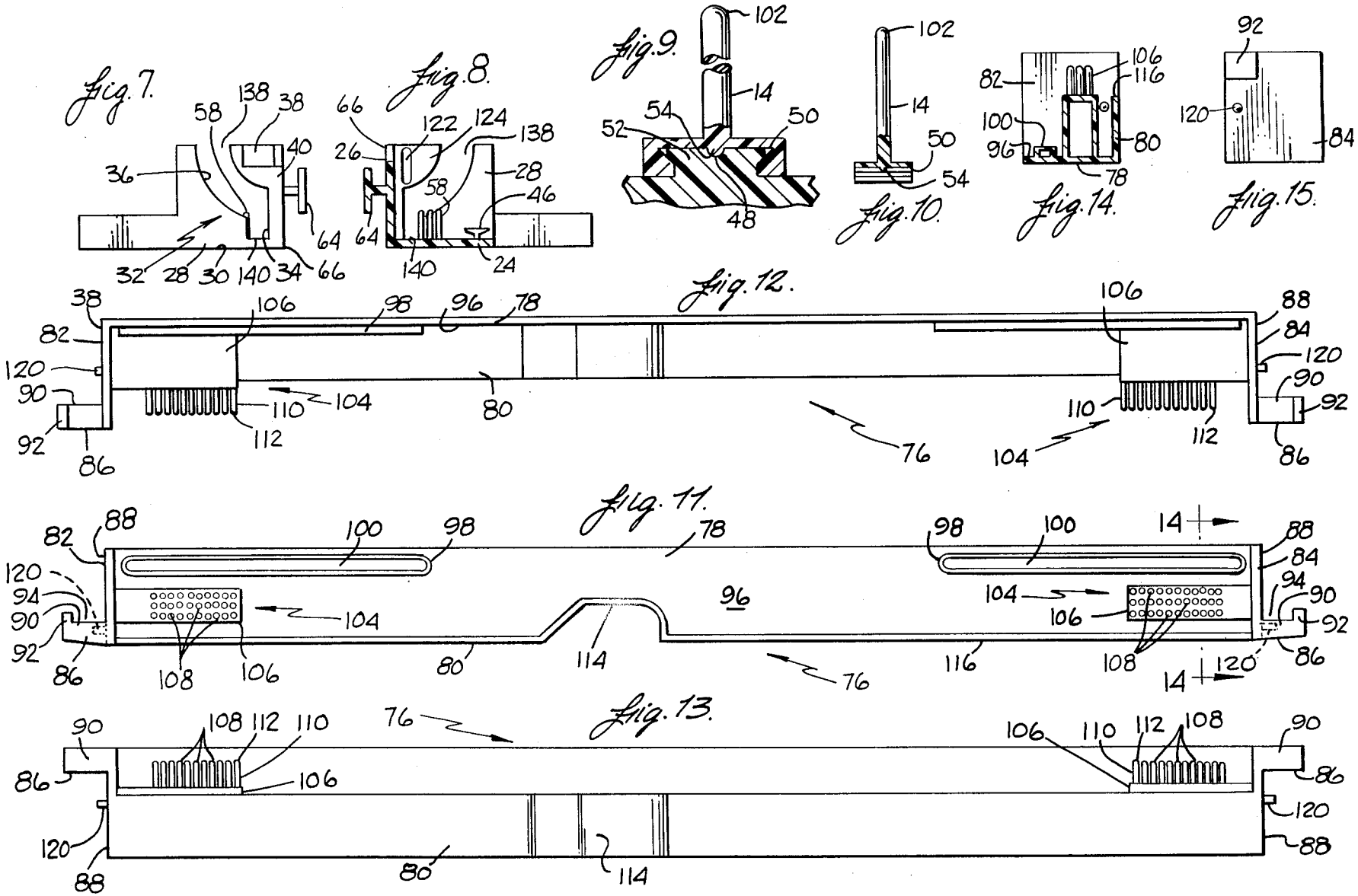
FIG. 8 is a cross-sectional view taken on the line 8—8 of FIG. 4.
FIG. 9 is an enlarged front elevational view partially in section of a support post means and a slide guide means as mounted on a slide bar portion for movably supporting the support post means.
FIG. 10 is a side elevational view of FIG. 9 with parts in section.
FIG. 11 is a bottom plan view of a closure member when in an intermediate position.
FIG. 12 is a side elevational view of the inside surface of the closure member looking from the top of FIG. 11.
FIG. 13 is a side elevational view of the outside surface of the closure member looking from the bottom of FIG. 11.
FIG. 14 is a cross-sectional view taken on the line 14—14 of FIG. 11.
FIG. 15 is a right end view of FIG. 11.

Extending upwardly from and integral with the inner surface 44 of the support plate portion 24 are a pair of spaced apart slide bar portions 46 having a dove-tailed cross-sectional configuration, as illustrated particularly in FIGS. 1 and 8. A plurality of spaced apart circular recesses 48 project downwardly from each slide bar portion 46 for a purpose described below. The longitudinal axes of the slide bar portions 46 coincide with each other and extend generally parallel to the longitudinal axis of the support plate portion 24. A slide guide means 50, as illustrated particularly in FIGS. 9 and 10, is provided for sliding movement over each of the slide bar portions 46. The support post means 14 projects upwardly from and is integral with the slide guide means 50. The slide guide means 50 has an inner recess portion 52 having a dove-tailed, cross-sectional configuration for mating engagement with the dove-tailed cross-sectional configuration of the slide bar portion 46. A centrally located inwardly projecting circular detent means 54 is provided in the inner recess portion 52 so as to cooperate with the recesses 48 in releasably retaining the support post means 14 at one of the desired locations along the slide bar portions 46. In the preferred embodiment of the invention, there are illustrated two slidably mounted support post means but it is within the scope of the invention to have one stationary support post means and one slidably mounted support post means. Also, in some instances it may be desirable to provide more than two support post means.

A pair of guiding and friction applying means 56 are provided on the support plate portion 24. Each guiding and friction applying means 56 comprises a plurality of pins 58 projecting upwardly from the inner surface 44 and integral therewith. Each pin 58 has a generally cylindrical outer surface 60 having a longitudinal axis extending perpendicular to the inner surface 44 and a tapered outer tip 62 for purposes described below.

Figure 4:
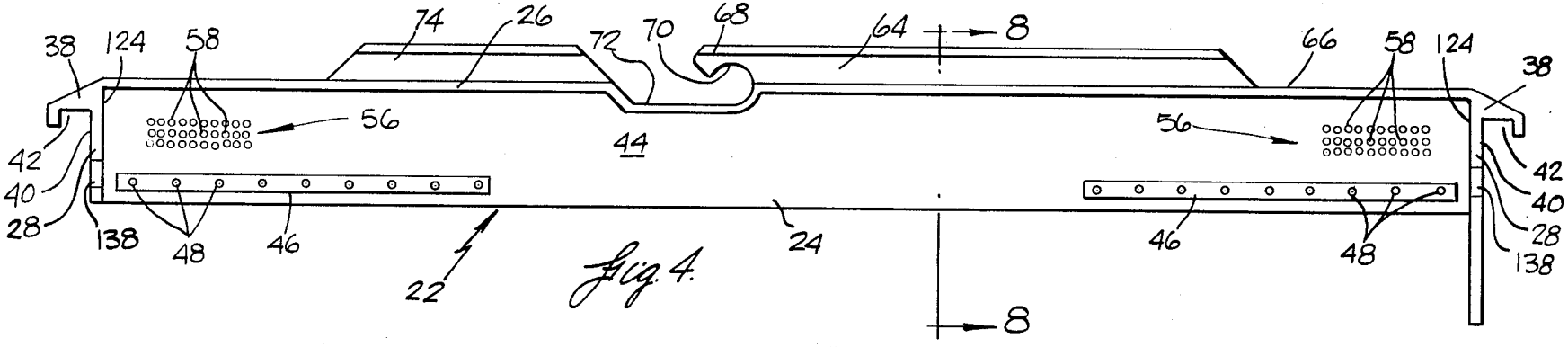
FIG. 4 is a top plan view of a main support member only for the apparatus when supported on a work surface.
Figure 5:
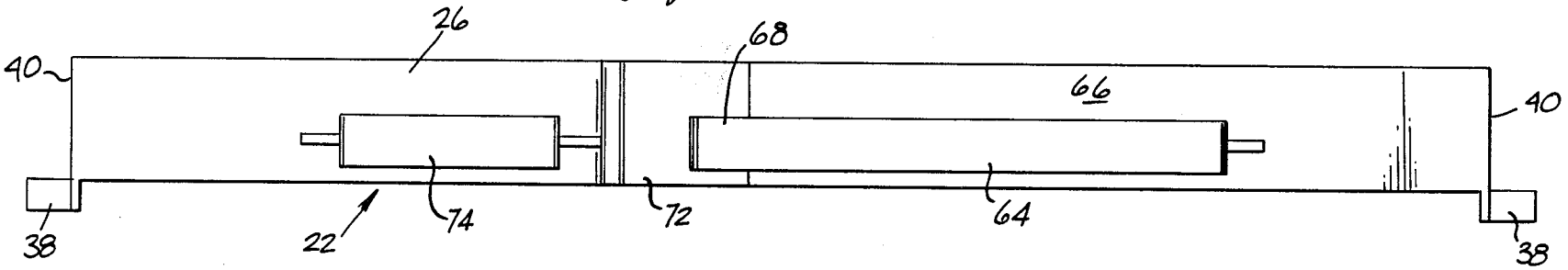
FIG. 5 is a side elevational view of the outside surface of the main support member looking from the top of FIG. 4.
Figure 6:
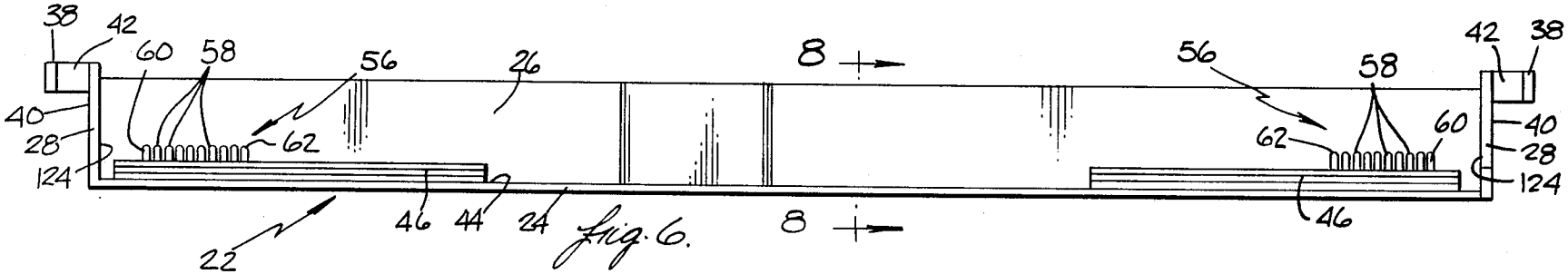
FIG. 6 is a side elevational view of the inside surface of the main support member looking from the bottom of FIG. 4.

A reinforcing flange portion 64 projects outwardly from and is integral with the outer surface 66 of the side flange portion 26 and is generally T-shaped in cross-sectional configuration. One end portion 68 of the reinforcing flange portion 64 has a generally arcuately shaped recess 70 formed therein. The side flange portion 26 is provided with a recessed portion 72 projecting inwardly from the outer surface 66. The arcuately shaped recess 70 faces the recessed portion 72 and cooperates therewith so that the apparatus may be supported on a rack 20 in a storage space as discussed below. As illustrated in FIG. 4, the one end portion 68 and the recessed portion 72 are at an off-center location. Another reinforcing flange 74 projects outwardly from and is integral with the outer surface 66 and is also generally T-shaped in cross-sectional configuration. The reinforcing flanges 64 and 74 facilitate placing of the document holder in storage spaces having parallel spaced apart racks accessible only from one side to cooperate therewith.

The apparatus 2, as illustrated in FIG. 1, also comprises a closure member 76, illustrated specifically in FIGS. 1 and 11–15, having an L-shaped cross-sectional configuration and made in one piece from a rigid molded plastic material and having an upper rigid horizontally extending elongated support plate portion 78 and located in vertically spaced parallel relationship to the support plate portion 24 when positioned on a support surface 24 in the intermediate position 8, illustrated in FIG. 2, to form a U-shaped slot therebetween. The support flange portion 78 is also located in laterally spaced parallel relationship to the support plate portion 24 when in the fully closed position illustrated in FIG. 3 and supported on the racks 18 or 20. A downwardly extending side flange portion 80 is integral with the support plate portion 78 and downwardly extending end flange portions 82 and 84 are integral with the support plate portion 78 and the side flange portion 80. The support plate portion 78 and the side flange portion 80 have generally rectangularly shaped cross-sectional configurations and generally parallel longitudinal axes which are also generally parallel to the longitudinal axes of the support plate portion 24 and the side flange portion 26 when assembled together. Each of the end flange portions 82 and 84 have an outwardly extending rib portion 86 projecting from the outer surface 88 thereof and having a portion 90 thereof located in one of the elongated slots 32 for guiding the pivotal and linear movement of the closure member 76, as described below, in the generally arcuate portion 36 and the generally linear portion 34 thereof. Each rib portion 86 has a projecting lip portion 92 that cooperates with the outer surface 40 of the end flange portion 28, when in a closed position, as illustrated in FIG. 3, to form a U-shaped reces 94 therebetween which is used to help support the apparatus when in a storage space as described below.

Extending downwardly from and integral with the inner surface 96 of the support plate portion 78 are a pair of spaced apart elongated members 98 having an elongated longitudinally extending groove 100 therein. The longitudinal axes of the grooves 100 are laterally opposite the longitudinal axes of the slide bar portions 46 so that when the apparatus 2 is in a fully closed position 16, as illustrated in FIG. 3, the tip portions 102 of the support post means 14 are located in the grooves 100 so that, when the apparatus 2 is in a fully closed position 16 and placed on racks 18 or 20 in a storage space, the tip portions 102 will bear against an adjacent portion of the grooves 100 so as to retain the documents 10 on the support post means 14 in a proper position.

A pair of guiding and friction applying means 104 are provided on the support plate portion 78 for cooperation with the guiding and friction applying means 56 on the support plate portion 24 as described below. Each guiding and friction applying means 104 comprises an elongated block 106 projecting downwardly from and integral with the inner surface 96 of the support plate portion 78. A plurality of pins 108 project downwardly from each elongated block 106 and are integral therewith. Each pin 108 has a generally cylindrical outer surface 110 having a longitudinal axis extending perpendicular to the inner surface 96 and a tapered outer tip 112 for purposes described below.

The side flange portion 80 is provided with a recessed portion 114 projecting inwardly from the outer surface 116 thereof. The recessed portion 114 cooperates with the recessed portion 72 to provide space for a rack 20 when the apparatus is supported on a rack in a storage space as described below.

The closure member 76 is pivotally mounted on the main support member by the pivot means 118 one part of which comprises a pivot pin 120 projecting outwardly from the outer surface 88 of the end flange portions 82 and 84. The other part of the pivot means 118 comprises elongated recess 122 formed in the inner surface 124 of each end flange portion 28 and adapted to receive the pivot pin 120 for pivotal movement and limited sliding movement therein. The pivot means 118 are located so that, when the outer surface 116 of the side flange portion 80 contacts the upper edge 128 of the side flange portion 26, the angle A between the edge portion 130 of the end flange portion 28 and the edge portion 132 of the end flange portion 82 is between about 92 and 98 degrees and preferably about 95 degrees as illustrated in FIG. 1. Also, the edge portion 134 of the end flange portion 82 and 84 is offset from the edge portion 136 of the end flange portions 28. The angle A is greater than 90 degrees so that the force of gravity will tend to keep the apparatus in the fully open position but not greater in an amount that would tend to tilt the apparatus from its position in the fully open position with the planar surface 30 in contact with the supporting surface 6.

The apparatus 2 is assembled by inserting the pivot pins 120 into the elongated recesses 122 and moving the portions 90 of the rib portion 86 through the open end portion 138 of the generally arcuate portions 36 of the elongate slots 32. The closure member 76 is pivoted toward the fully open position 4, illustrated in FIG. 1, until the outer surface 116 of the side flange portion 80 contacts the upper edge 128 of the side flange portion 26. The apparatus 2 is then positioned on a support surface 6 with the planar outer surface 30 of the support plate portion 24 in contact therewith. As illustrated in FIG. 1, the main support member 22 lies flat on the support surface so that the support post means 14 extend in a direction perpendicular to the work surface so as to make the insertion or removal of documents an easy operation. Documents 10 are positioned adjacent the support plate portion 24 and the support post means 14 are moved over the slide bar portions 46 to align the support post means 14 with the holes 12 in the documents 10. The documents 10 are then placed over the support post means 14. When the desired number of documents 10 have been positioned on the support post means 14, the closure member 76, guided by the portions 90 in the generally arcuate portions 36, is pivoted about the pivot means 118 until the portions 90 of the rib portions 86 have reached the junction of the generally arcuate portions 36 and the generally linear portions 34 of the elongated slots 32 with the tapered outer tips 112 of the pins 110 spaced slightly above the tapered outer tips 64 of the pins 60 and with all of their longitudinal axes in generally parallel relationship, as illustrated in FIG. 2A. The closure member 76 is then allowed to move under the influence of gravity in a linear direction guided by the portions 90 in the generally linear portions 34 until the tapered tips 112 of the pins 108 are intermeshed with the tapered outer tips 62 of the pins 58. Pressure is then applied to the closure member 76 so as to move the closure member 76 in a linear direction toward the main support member 22 with the pins 108 intermeshing with the pins 58. The pins 58 and 108 have corresponding diameters and spacing so that when the pins 58 and 108 are in an intermeshing relationship, the generally cylindrical outer surface 60 of any pin 58 has surface contact with the generally cylindrical outer surface 110 of the adjacent pins 108 and vice versa. This provides both a frictional force tending to hold the main support member 22 and the closure member 76 in a fully closed position and a guiding means for the relative linear movement between the main support member 22 and the closure member 76 when moving between the intermediate position 8 and the fully closed position 16. The relative linear movement between the main support member 22 and the closure member 76 is continued until the portion 90 of each of the rib portions 86 abuts against the closed end portion 140 of each of the generally linear portions 34 of the elongated slots 32. When the apparatus 2 is in the fully closed position 16, the portion 90 of each of the rib portions 86 will abut against an edge of the generally linear portion 34 of the elongated slot 32 to provide a positive locking force to prevent inadvertent separation of the main support member 22 and the closure member 76. The fully closed apparatus 2 is then moved to a suitable storage area and the apparatus 2 is placed on racks, such as those illustrated in FIG. 3. In one type of storage space, the hook portions 38 and the portions 90 are in contact with and supported by the racks 18. In another type of storage space, the arcuate shaped recess 70 of the one end portion 68 is in contact with and supported by the rack 20.

When it is desired to remove some or all of the documents 10, the apparatus 2 is removed from the storage space and taken to a work area where it is positioned on the support surface 6 with the planar outer surface 30 of the main support member 22 and the bottom one of the documents 10 in contact with the support surface 6.

Fingers of each hand are then placed on the hook portions 38 and the lip portions 92 of the rib portions 86 and sufficient pressure in a vertical direction is applied to the lip portions 92 to overcome the frictional forces generated by the surface contact between the pins 58 and 108 to cause linear movement of the closure member 76 until the portions 90 reach the juncture of the generally linear portion 34 and the generally arcuate portion 36 at which time the pins 108 have been separated from the pins 58, as illustrated in FIG. 2A. This means that the forces being applied to unlock the closure member 76 from the main support member 22 are acting in the same direction as the forces for the opening of the apparatus 2 to make the opening process an easy operation. At this time, a lateral force is added to the vertical force so as to pivot the closure member 76 around the pivot means 118 until it reaches the fully open position 4, as illustrated in FIG. 1, so that the documents 10 can be exchanged as desired. As illustrated in FIG. 3, the edge portion 128 of the side flange portion 26 is recessed relative to the edge portions 142 of the end flange portions 28 to provide clearance for the pivotal movement of the closure member 76.

It is contemplated that the inventive concepts herein described may be variously otherwise embodied and it is intended that the appended claims be construed to include alternative embodiments of the invention except insofar as limited by the prior art.

What is claimed is:

1. Apparatus for use in supporting a plurality of computer print-out documents having a series of linearly aligned holes along one edge thereof in a storage space comprising:

a main elongated support member having an L-shaped cross-sectional configuration and made of one piece of rigid molded plastic material and being defined, when said main support member is positioned on a supporting surface, by a lower rigid horizontally extending elongated support plate portion having an inner surface and an outer surface and an upwardly extending side flange portion integral therewith and upwardly extending end flange portions integral with said lower rigid horizontally extending elongated support plate portion and said side flange portion and each of said end flange portions having an elongated slot having a generally linear portion and a generally arcuate portion therein and having a closed end and an open end;

an elongated closure member;

pivot means for pivotally connecting said closure member to said main support member;

said closure member having an L-shaped cross-sectional configuration and made of one piece of molded plastic material and being defined, when in a fully closed position over said main support member when positioned on said supporting surface, by an upper rigid horizontally extending elongated support plate portion having an inner surface and an outer surface and a downwardly extending side flange portion integral therewith and downwardly extending end flange portions integral with said upper rigid horizontally extending elongated support plate portion and said side flange portion and each of said end flange portions having at least one outwardly extending rib portion projecting therefrom and having a portion thereof located in one of said elongated slots for guiding the movement of said closure member between a fully closed position whereat said upper rigid horizontally extending elongated support plate portion of said closure member is located in a vertically spaced parallel relationship to said lower rigid horizontally extending elongated support plate portion of said main support member to define a U-shape slot means therebetween and a fully open position whereat said side flange portion of said closure member is supported on said side flange portion of said main support member and said upper rigid horizontally extending elongated support plate portion of said closure member is laterally offset from said side flange portion of said main support member to enable insertion and removal of documents, the movement comprising a sliding movement between said main support member and said closure member in a linear direction between said fully closed position and an intermediate position and a pivotal movement between said main support member and said closure member from said intermediate position to said fully open position;

at least two, spaced apart, elongated support post means mounted on the inner surface of said lower rigid horizontally extending elongated support plate portion of said main support member for telescopic insertion into at least two spaced holes in the documents or removal from said support post means when in said fully open position and whereby the documents are supported by said support post means in said U-shape slot means when in said fully closed position and placed in said storage space;

said outer surface of said lower rigid horizontally extending elongated support plate portion of said main support member being generally planar so that, when said main support member is positioned on said supporting surface, said elongated support post means will extend in a direction perpendicular to said supporting surface; and locking means for holding said main support member and said closure member in said fully closed position.

2. Apparatus as in claim 1 wherein said pivot means comprises:

a pivot pin projecting outwardly from each of said end flange portions of said closure member;

an inner surface on each of said end flange portions;

an elongated slot on the inner surface of each of said end flange portions of said main support member; and a portion of said pivot pin located in said elongated slot for sliding and pivotal movement therein.

3. Apparatus as in claim 1 and further comprising:

guiding and frictional holding means on said inner surfaces of said lower rigid horizontally extending elongated support plate portion of said main support member and said upper rigid horizontally extending elongated support plate portion of said closure member.

4. Apparatus as in claim 3 wherein said guiding and frictional holding means comprises:

a plurality of elongated pins at spaced apart locations on said inner surface of said lower rigid horizontally extending elongated support plate portion of said main support member and extending perpendicular thereto in a direction away from said inner surface;

a plurality of elongated pins at spaced apart locations on said inner surface of said upper rigid horizontally extending elongated support plate portion of said closure member and extending perpendicular thereto in a direction away from said inner surface; and said plurality of elongated pins being located on said inner surfaces of said lower rigid horizontally extending elongated support plate portion of said main support member and said upper rigid horizontally extending elongated support plate portion of said closure member so that when said closure member is moved in a linear direction toward said closed position, said plurality of elongated pins on said inner surface of said upper rigid horizontally extending elongated support plate portion of said closure member will intermesh with said plurality of elongated pins on said inner surface of said lower rigid horizontally extending elongated support plate portion of said main support to guide said closure member to said fully closed position and to provide frictional forces tending to hold said closure member and said main support member in said fully closed position.

5. Apparatus as in claim 4 and further comprising:

all of said elongated pins being of substantially equal longitudinal extent.

6. Apparatus as in claim 5 wherein said locking means comprises:

a portion of each of said outwardly extending rib portions in abutting relationship with a portion of each of said linear portions of said elongated slots.

7. Apparatus as in claim 1 and further comprising:

adjustable mounting means for mounting at least one of said at least two support post means so that said at least one of said at least two support post means may be moved to vary the spacing between said at least two support post means.

8. Apparatus as in claim 7 wherein said adjustable mounting means comprises:

a dovetail bar mounted on said inner surface of said lower rigid horizontally extending elongated support plate portion and extending generally in a direction parallel to the longitudinal axis thereof;

a slide having a dovetail groove for mating engagement with said dovetail bar for sliding movement thereover;

mounting means for mounting one end of said at least one of said elongated support post means on said slide; and means on said inner surface of said upper rigid horizontally extending elongated support plate portion of said closure member for receiving and supporting the other end of said at least one of said elongated support post means.

9. Apparatus as in claim 8 and further comprising:

detent means at spaced apart locations for releasably retaining said slide means at one of said spaced apart locations.

10. Apparatus as in claim 7 and further comprising:

a storage space;

at least one elongated rod fixedly mounted in said storage space; and support means on said apparatus for supporting said apparatus on said at least one elongated rod in said storage space.

11. Apparatus as in claim 10 wherein said support means comprises:

an outer surface on said side flange portion; and a support hook integral with and projecting outwardly from said outer surface of said side flange portion of said main support member.

12. Apparatus as in claim 10 and further comprising:

an elongated relatively narrow member integral with and extending downwardly from at least one of said end flange portions of said main support member; and said elongated relatively narrow member having an outwardly facing surface on which identifying indicia may be secured.

13. Apparatus as in claim 1 and further comprising:

guiding and frictional holding means on said inner surfaces of said lower rigid horizontally extending elongated support plate portion of said main support member and said upper rigid horizontally extending elongated support plate portion of said closure member;

said frictional holding means acting to retain said main support member and said closure member in said fully closed position;

adjustable mounting means for mounting at least one of said at least two support post means for permitting movement of said at least one of said at least two support post means to vary the spacing between said at least two support post means;

a storage space;

a plurality of elongated rods fixedly mounted in said storage space; and a plurality of support means on said apparatus for supporting said apparatus on said rods in said storage space.

14. Apparatus for use in supporting a plurality of documents having a series of linearly aligned holes along one edge thereof in a storage space comprising:

an integrally molded, elongated main support member having an inner surface and an outer surface;

at least two, spaced apart elongated support post means mounted on a portion of said inner surface of said main support member and having exposed ends over which documents may be placed and supported;

an integrally molded, elongated closure member having an inner surface and an outer surface;

pivot means for pivotally connecting said main support member and said closure member for permitting pivotal movement of said closure member between a fully open position for placing documents onto or removing documents from said at least two elongated support post means and an intermediate position wherein at least a portion of said inner surface of said closure member is superposed over and substantially parallel to at least a portion of said inner surface of said main support member and spaced from said exposed ends of said at least two support post means;

slide means on said main support member and said closure member for permitting relative linear sliding movement between said main support member and said closure member toward or away from each other between said intermediate position and a fully closed position; and said slide means providing locking means on said main support member and said closure member to prevent pivotal movement between said main support member and said closure member when said main support member and said closure member are in a fully closed position.

15. Apparatus as in claim 14 and further comprising:
guiding and frictional holding means, separate from said at least two elongated support post means and said slide means, on portions of said inner surfaces of said main support member and said closure member for guiding said linear sliding movement between said main support member and said closure member between said intermediate position and said fully closed position and to provide a frictional force tending to hold said main support member and said closure member in said fully closed position.

16. Apparatus as in claim 14 and further comprising:
adjustable mounting means for mounting at least one of said at least two elongated support post means for permitting movement of said at least one of said at least two support posts means to vary the spacing between said at least two support post means.

17. Apparatus as in claim 14 and further comprising:
a storage space;
a plurality of elongated rods fixedly mounted in said storage space; and
a plurality of support means on said apparatus for supporting said apparatus on said rods in said storage space.

18. Apparatus as in claim 15 and further comprising:
adjustable mounting means for mounting at least one of said at least two elongated support post means for permitting movement of said at least one of said at least two elongated support posts means to vary the spacing between said at least two elongated support post means;
a storage space;
at least one elongated rod fixedly mounted in said storage space; and
at least one support means on said apparatus for supporting said apparatus on said at least one elongated rod in said storage space.

19. A method for providing apparatus for supporting a plurality of documents having a series of linearly aligned holes along one edge thereof in a storage space comprising:
integrally molding a main support member to have an inner and outer surface with at least two, spaced apart, elongated support post means projecting from portions of said inner surface and having exposed ends over which documents may be placed and supported;
integrally molding a closure member to have an inner surface and an outer surface;
pivotally connecting said closure member to said main support member for permitting pivotal movement of said closure member between a fully open position for placing documents onto or removing documents from said at least two elongated support post means and an intermediate position wherein at least a portion of said inner surface of said closure member is superposed over and substantially parallel to at least a portion of said inner surface of said main support member and spaced from said exposed ends;
slidably connecting said closure member and said main support member so that said closure member may be moved in a linear direction toward or away from said main support member between said intermediate position and a fully closed position with portions of said inner surface of said closure member in contact with said exposed ends; and
providing locking means for preventing pivotal movement between said main support member and said closure member together when said main support member and said closure member are in said fully closed position.

20. A method as in claim 19 and further comprising:
applying guiding and frictional forces on portions of said main support member and said closure member to guide said movement of said closure member between said intermediate position and said fully closed position and to frictionally hold said main support member and said closure member in said fully closed position.

21. Apparatus for use in supporting a plurality of documents having a series of linearly aligned holes along one edge thereof comprising:
an elongated main support housing means made of one piece of molded plastic material for supporting the documents;
spaced pin means on said main support housing means for being located in spaced ones of the holes;
a separate closure means made of one piece of molded plastic material and being movably mounted relative to said main support housing means for movement between a pluralitty of positions including a closed storage position providing an elongated channel for receiving and supporting the documents and an open position where at documents may be mounted on an removed from said pin means;
a pair of spaced pivotal connecting means located at opposite end portions of said main support housing means and said separate closure means for enabling the movement between said plurality of positions;
cam slot means in said opposite end portions of said main support housing means for providing a predetermined path of movement; and
cam follower means on said opposite end portions of said closure means for supportive engagement with said cam slot means and for guiding the pivotal movement of said closure means between the open position and the closed position.

22. Apparatus as in claim 21 and further comprising:
guiding and frictional holding means mounted on each of said main support housing means and said closure means for cooperative engagement and disengagement during movement between said open position and said closed position.

23. Apparatus as in claims 21 or 22 and further comprising:
rib means mounted on said main support housing means for slidably supporting at least one of said pin means for movement between a plurality of variably spaced positions;
said one of said pin means comprising a support base means portion for slidable supportive engagement with said rib means and a pin means portion mounted on said support means portion.

24. Apparatus as in claim 23 and further comprising:
spaced separate detent means on said rib means for holding said one of said pin means in a plurality of spaced locations therealong; and
projection means on said support base means portion for engagement with said detent means to selectively hold said pin means in one of said spaced locations.

25. Apparatus as in claim 24 and wherein:

said cam slot means includes a curved portion for enabling pivoted swinging movement and a linear portion for enabling a linear path of movement.

26. Apparatus as in claim 26 and wherein:

said linear path of movement defined by said cam slot means is located next adjacent the closed position to enable relative lateral displacement while maintaining parallelism between said main support housing means and said closure means and provides locking means for preventing pivotal movement in the closed position.

27. Apparatus as in claim 22 and wherein said guiding and frictional holding means comprises:

at least two groups of closely spaced pin members arranged in a regular pattern with pin passages therebetween;

one of said groups of pin members being mounted on said main support housing means and another one of said groups of pin members being mounted on said closure means; and said one of said groups of pin members being offset from the other of said group of pin members so that the pin members of one group enter the pin passages of the other group and frictionally engage one another during movement between the open position and the closed position.

28. Apparatus as in claim 27 and wherein:

there being four groups of said pin members with two groups on each of said closure means and said main support housing means located adjacent each of said pivotal connecting means.

29. Apparatus as in claim 24 and further comprising:

pin support means on said closure means for receiving and supporting an end portion of said pin means in said closed position.

30. Apparatus as in claim 27 and wherein:

one of said pin support means comprises an elongated slot means for supporting said one of said pin means in each of said adjusted positions.

31. Apparatus for use in supporting a plurality of documents having a series of linearly aligned holes along one edge thereof comprising:

an elongated main support housing means made of one piece of molded plastic material for supporting the documents;

spaced pin means on said main support housing means for being located in spaced ones of the holes;

a separate closure means made of one piece of molded plastic material and being movably mounted relative to said main support housing means for movement between a plurality of positions including a fully closed storage position providing an elongated channel for receiving and supporting the documents and a fully opened position where at documents may be mounted on and removed from said pin means;

a pair of spaced pivotal connecting means located at opposite end portions of said main support housing means and said separate closure means for enabling the pivotal movement between said plurality of positions; and linear movement permitting means for permitting linear movement between said housing means and said separate closure means from one of said positions to said fully closed position.

32. Apparatus as in claim 31 wherein said pivotal connecting means comprises:

each of said housing means and said closure means having opposite end wall portions which are located in parallel side by side relationship and are movable relative to one another;

a pin means on each opposite end wall portion of one of said housing means and said closure means for providing a pivot axis for said housing means and said closure means; and an elongated pin slot means on each opposite end wall portion of the other one of said housing means and said closure means for receiving an associated one of said pin means and for preventing separation of said housing means and said closure means.

33. Appartus as in claim 32 and further comprising:

a cam follower means on each opposite end wall portion of one of said housing means and said closure means for guiding and controlling the path of movement of said housing means and said closure means relative to one another;

a cam slot means on each opposite end wall portion of the other one of said housing means and said closure means for receiving an associated one of said cam follower means and controlling the path of movement of said housing means and said closure means relative to one another.

* * * * *